US005875802A

United States Patent [19]

Favaro et al.

[11] Patent Number: 5,875,802

[45] Date of Patent: Mar. 2, 1999

[54] WASHLOAD DRYING ARRANGEMENT OF DISHWASHING MACHINES

[75] Inventors: Daniele Favaro, Venezia; Claudio Milocco, Trieste; Gianluca Tassotti, Pordenone, all of Italy

[73] Assignee: Electrolux Zanussi Elettrodomestici S.p.A., Pordenone, Italy

[21] Appl. No.: 805,271

[22] Filed: Feb. 25, 1997

[30] Foreign Application Priority Data

Apr. 10, 1996 [IT] Italy ..... 95A000023

[51] Int. Cl.[6] ..... B08B 3/10

[52] U.S. Cl. ..... 134/102.3; 134/105; 134/108; 34/72; 34/235

[58] Field of Search ..... 134/94.1, 95.1, 134/95.2, 95.3, 98.1, 102.1, 102.3, 103.1, 107, 108, 105, 102.2; 312/213, 214, 218; 34/72, 235

[56] References Cited

U.S. PATENT DOCUMENTS

| | | | |
|---|---|---|---|
| 1,552,972 | 9/1925 | Walker | 134/95.2 |
| 1,624,461 | 4/1927 | Barker | 134/95.2 |
| 2,674,249 | 4/1954 | Knight | 134/95.3 |
| 2,960,990 | 11/1960 | Jones et al. | 134/95.3 |
| 3,026,628 | 3/1962 | Berger, Sr. et al. | 134/102.1 |
| 3,068,877 | 12/1962 | Jacobs | 134/108 |
| 3,103,737 | 9/1963 | Jellies | 134/95.2 |
| 3,200,621 | 8/1965 | Worst | 134/94.1 |
| 3,550,521 | 12/1970 | Carrie | 134/95.1 |
| 3,807,420 | 4/1974 | Donselman et al. | 134/102.3 |
| 4,188,732 | 2/1980 | Quayle | 134/95.3 |
| 5,056,543 | 10/1991 | Dygve | 134/107 |
| 5,076,306 | 12/1991 | Suzuki et al. | 134/95.2 |
| 5,273,061 | 12/1993 | Milocco | 134/155 |
| 5,277,210 | 1/1994 | Kim | 134/95.2 |
| 5,355,900 | 10/1994 | Sakata | 134/95.2 |

FOREIGN PATENT DOCUMENTS

| | | | |
|---|---|---|---|
| 1926049 | 11/1970 | Germany | 134/107 |
| 227944 | 1/1925 | United Kingdom | 134/98.1 |

*Primary Examiner*—Frankie L. Stinson
*Attorney, Agent, or Firm*—Pearne, Gordon, McCoy & Granger LLP

[57] ABSTRACT

Dishwashing machine including a washing tank (1) provided with an upper aperture (6) and a lower aperture (7) that are interconnected through a conduit (8) extending outside the tank. During drying, the vapor in the tank is caused to circulate along a closed-loop flow-path defined by the tank and the conduit (8), thereby reducing to a minimum the effect of thermal stratification of the vapor in the tank and, as a result, favoring a homogeneous drying effect of the washload items.

5 Claims, 2 Drawing Sheets

WASHLOAD DRYING ARRANGEMENT OF DISHWASHING MACHINES

BACKGROUND OF THE INVENTION

The present invention refers to a dishwashing machine provided with an improved arrangement for drying the washload in a system where the vapor released by the washload accommodated in a washing tank tends to condense mainly on the inner walls of the same washing tank. In other words, the present invention refers to a dishwashing machine which is adapted to dry the washload without using any special system provided with a condenser.

Dishwashing machines with washload drying systems provided with a condenser arrangement are largely known in the art. As disclosed for instance in U.S. Pat. No. 5,273 061, a specially provided condenser arranged in the washing tank of a dishwashing machine is traversed by a flow of cooling ambient air circulated therethrough by a fan. The vapor which is present in the washing tank at the end of a rinsing phase carried out with hot water, condenses on to the outer walls of the condenser, thereby promoting an efficient drying of the washload items.

Solutions are also well known, for instance from U.S. Pat. No. 5,056,543, in which the moisture-laden hot air present in the washing tank is circulated directly through the condenser (where it cools down and gives off its humidity) which can possibly be associated to auxiliary cooling means.

In any case, all such known drying arrangements making use of a condenser have a drawback in that the moisture-laden hot air contained in the washing tank of the machine can cool down to an excessive extent when in contact with the condenser, thereby cooling down the washload to be dried correspondingly. As a result, the evaporation of the water from the washload is reduced, so that it becomes necessary for the washload to be submitted to forced heating, which is usually performed by appropriately operating the heating elements of the machine "in air", i.e., under dry conditions, when they are not wetted by the washing or rinsing liquor. As commonly known, this gives rise to undesired effects of possible overheating of component parts of the machine and plates additional stresses onto the electromechanical and/or electronic interfaces associated to the heating elements themselves. This adds to the fact that the provision of a condenser and the component parts that are usually associated therewith undesirably complicates the structure of the whole dishwashing machine and substantially increases the manufacturing and operating costs thereof.

On the other hand, in the dishwashing machines of the traditional type that are not equipped with a condenser for the drying operation, the vapor that is produced inside the washing tank at the end of a rinsing phase carried out with hot water generally gives rise an undesired thermal stratification. In particular, the temperature of such a vapor is higher in the upper portion of the tank interior (where at least a first washload holding rack or basket is usually provided), while it is lower in the lower portion of the same tank interior, where at least a second washload holding rack is usually provided. The temperature of the washload items in the different holding racks will of course be correspondingly different. For instance, approximately 10 minutes from the conclusion of a rinse carried out with water which had been heated up to 65° C., in correspondence of the ceiling of the washing tank, to a minimum of approximately 25° C. in correspondence of the bottom of the same washing tank.

It is substantially in these conditions that the washload drying process takes place owing to the evaporation of residual water from the same washload items during a subsequent pause in the operation of the machine. The vapor released by the washload items tends to condensate mainly on the inner walls of the washing tank, which during this period of time tend to cool down, in a substantially homogeneous manner, more rapidly than the washload items themselves. Since the extent to which the washload items are able to dry is proportional to the thermal difference existing between the washload items themselves and the walls of the washing tank, the result is that the (colder) washload items arranged in the lower rack get dry in a less efficient manner than the warmer washload items arranged in the upper rack. In practice, the extent to which the washload items in the lower rack get dry is sometimes quite unsatisfactory. Anyway, the overall drying effect of the washload items in the washing tank of the machine appears to be undesirably non-homogeneous.

It is therefore a common practice to try to improve the drying effect of the washload items in a dishwashing machine by providing, as this is for instance described in the Italian Utility Model Application No. PN91 U 000045, means that are adapted to bring about, when the machine is not operating, a natural circulation of ambient air through the washing tank of the dishwashing machine. Such a solution is, however, associated with an important drawback in that the dishwashing machine is able to release vapor into the surrounding ambient atmosphere, thereby giving rise to a number of practical problems as anyone skilled in the art is well aware of.

France Patent No. FR-A-1 116 585 discloses a dishwasher with a wash tub in which a propeller is provided to project water onto the crockery for washing purposes. To dry the crockery, the propeller is subsequently operated to agitate hot air inside the wash tub so that vapor released by the crockery is brought into contact with the walls of the wash tub, where it is condensed. Thermal stratification is, however not prevented in an effective way in the whole wash tub and, in fact, the walls of the tub itself must not be thermally isolated in order to be kept sufficiently cold, thereby enabling condensation of vapor thereon. In other words, the cold walls of the wash tub operate as a condenser. As a consequence, unacceptable thermal losses occur through the walls of the wash tub during the wash cycle.

BRIEF SUMMARY OF THE INVENTION

It is, therefore, a main purpose of the present invention to provide a dishwashing machine provided with a simple improved arrangement adapted to enable the washload items to be dried in a substantially homogeneous manner without substantially causing any vapor to be released into the surrounding ambient.

In particular, it is a purpose of the present invention to provide a dishwashing machine of the above cited kind, which is capable of drying the washload items in an effective manner without requiring the use of any purpose-provided condenser-based drying arrangement.

According to the present invention, these aims are reached in a dishwashing machine with improved washload drying arrangement embodying the features as recited in the appended claims.

BRIEF DESCRIPTION OF THE SEVERAL VIEWS OF THE DRAWINGS

The characteristics and the advantages of the invention will be more clearly and readily apparent from the description which is given below by way of non-limiting example with reference to the accompanying drawings, in which.

DESCRIPTION OF THE INVENTION

Figure 1:
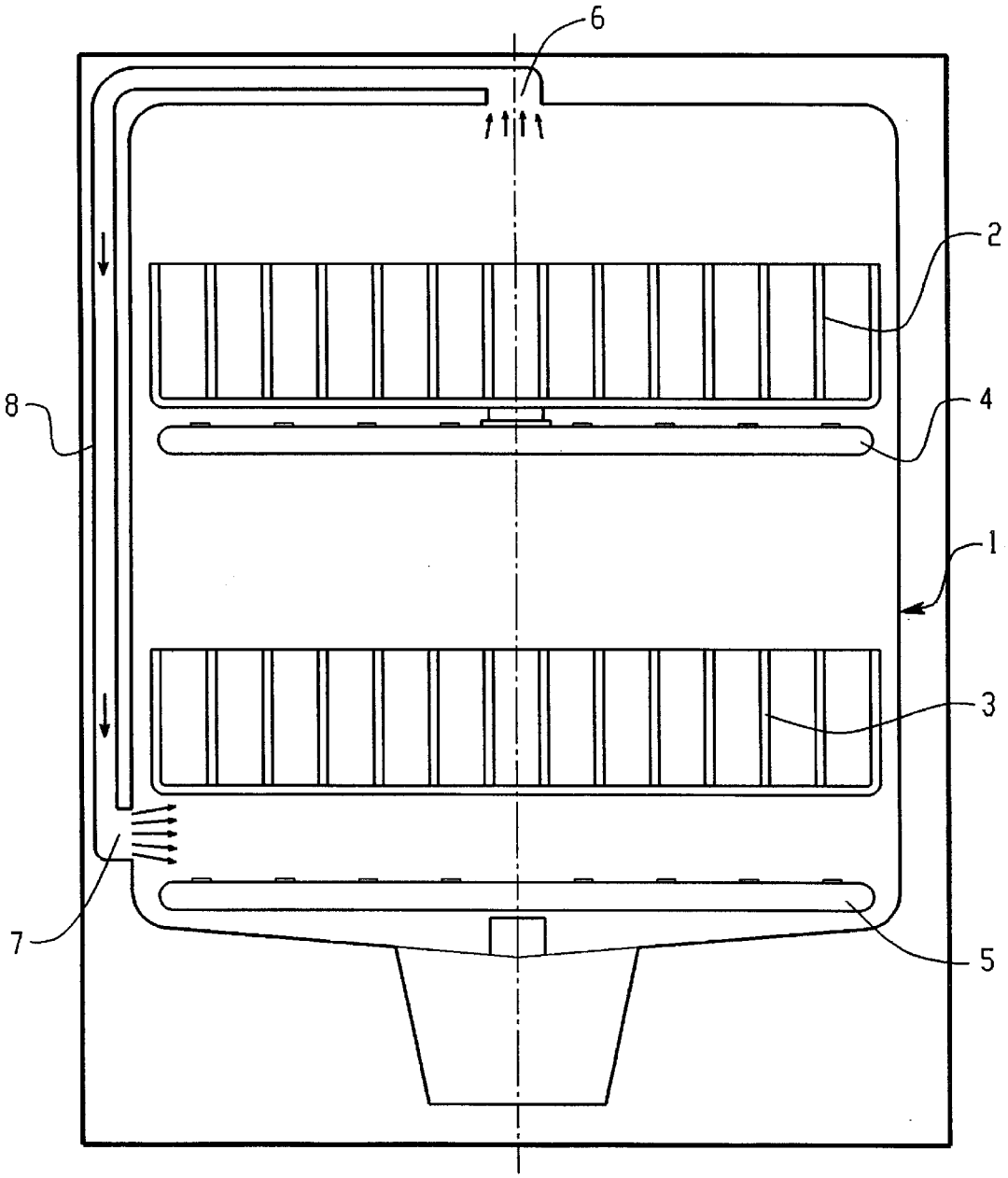
FIG. 1 is a schematic view illustrating only the main component parts of a preferred embodiment of the dishwashing machine according to the present invention.

Referring particularly to FIG. 1, it can be seen that the dishwashing machine is of an automatic type and comprises mainly a washing tank 1 accommodating at least an upper rack 2 and at least a lower rack 3 intended to hold respective washload items (not shown) that are washed and/or rinsed in a traditional manner by means of rotating spray arms 4, 5, or similar means, each one of them arranged below a respective rack.

For reasons of greater simplicity, the means through which the rotating spray arms 4, 5, are supplied with water under pressure in a known manner are not shown, nor are shown the heating means with which the water supplied to said rotating spray arms can be heated up, even in this case in a known manner, in accordance with the operation cycles being performed by the machine.

The dishwashing machine may generally operate in a substantially traditional manner, i.e., is capable of performing operation cycles, at least one of which comprises a final washload rinse phase carried out with hot water (e.g. at a temperature of 65° C.).

According to the present invention, the machine comprises flow-promoting or flow-generating means adapted to cause a circulation (or turbulence) of the vapor being present inside the washing tank 1 to take place during a drying phase following the above cited final rinse phase.

Figure 2:
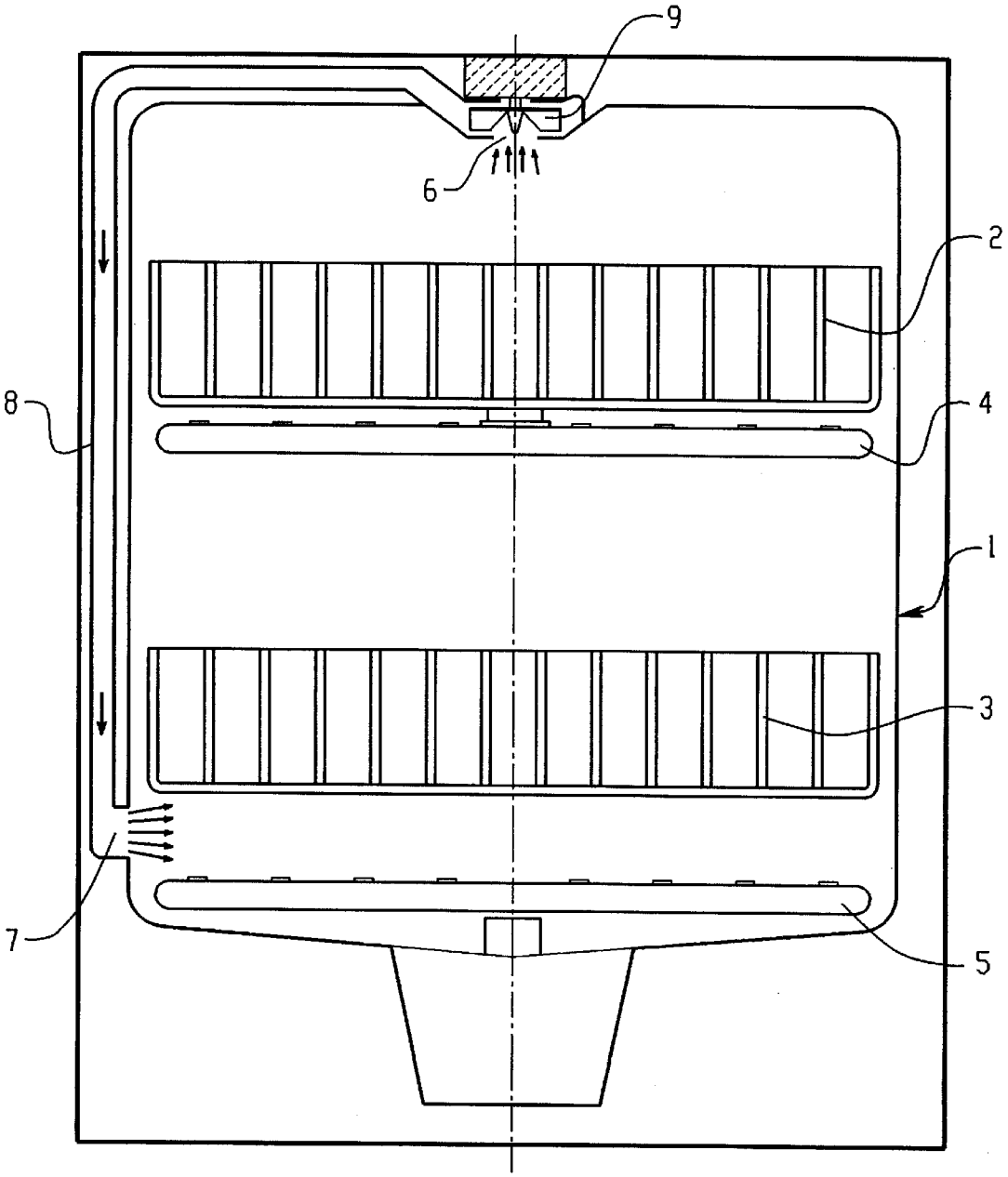
FIG. 2 is a schematical view of a variant of the dishwashing illustrated in FIG. 1.

In a preferred manner, said flow-generating means comprise at least an upper aperture 6 and at least a lower aperture 7 that are provided in the washing tank 1 and are interconnected through at least a conduit 8 which is arranged outside the washing tank and preferably extends in the cavity comprised between the tank 1 and the outer casing of the machine. As a result, during the washload drying phase a natural circulation of the vapor (in the direction indicated by the arrows in FIG. 1 occurs along a closed-loop flow-path defined by the tank 1 and the conduit 8, said circulation tending in such manner to involve the washload items contained in the racks 2, 3, and to promote a substantial evenness of the vapor temperature throughout the interior of the washing tank. The conduit 8 interconnects the upper and lower apertures 6, 7 without a dehumidifier therein as shown in FIGS. 1 and 2.

The aperture 6 will, of course, be preferably provided in correspondence of the ceiling of the washing tank, while the aperture 7 will preferably be provided in a point adjacent to the bottom of the same washing tank. As it has also been found experimentally in a dishwashing machine of a traditional type and general sizing, during a drying phase following a rinse performed with water at 65° C., the above cited natural circulation of the vapor along the flow-path 1, 6, 7, 8 is capable of reducing the thermal stratification of the vapor inside the washing tank to a substantial extent. In particular, approximately 10 minutes after the rinsing water has been let off the machine, the temperature of the vapor tends to differentiate from a maximum of approximately 50° C. in correspondence of the ceiling of the tank, to a minimum of approximately 35° C. in correspondence of the bottom of the same tank. Therefore, in a quite advantageous and, at the same time, very simple manner, the temperature of the washload items tends to become uniform so as to enable the same washload items to dry in a substantially homogeneous manner owing to the evaporation of the residual water which, in a known manner, tends to condense onto the colder inner walls of the washing tank 1.

In other words, as compared to traditional solutions, the temperature of the washload items in the upper rack 2 stays at a value which is sufficient to make sure that the same washload items are able to dry adequately, while the temperature of the washload items in the lower rack 3 increases to such an extent at to prevent the same washload items from drying in an incomplete or, anyhow, inadequate manner.

It should additionally be noticed that the drying effect of the washload items is actually improved by the ventilation which they are subject to due to the effect of the aforementioned circulation of the vapor. Furthermore, in a quite advantageous manner the vapor itself is not released into the surrounding environment, thereby doing away with the drawbacks typically associated with such a release.

With reference to FIG. 2, it can be noticed that the drying effect of the washload items in the dishwashing machine can be further improved by increasing the speed at which the flow of vapor is circulated along said closed-loop flow-path 1, 6, 7, 8 by means of a motor-driven fan 9 or similar means which may, for instance, be situated in correspondence of the upper aperture 6.

As it has also been found experimentally, during a drying phase following a rinsing phase carried out with water at 65° C., the above cited circulation of the vapor along the flow-path 1, 6, 7, 8, when assisted by such a fan or similar means 9, does substantially away with the typical stratification of the vapor inside the washing tank. In particular, the temperature of the vapor tends to become uniform throughout the interior of the tank, where it reaches a value of approximately 47° C. after approximately 10 minutes from the rinsing water having been let off the machine.

It will of course be appreciated that the aforedescribed dishwashing machine may be subject to a number of modifications and variations without departing from the scope of the present invention.

What is claimed is:

1. A dishwashing machine comprising a washing tank (1) and adapted to perform operational cycles including at least one phase using hot water for rinsing washload items that are arranged in the washing tank wherein evaporation of residual water from the washload items during a drying phase causes vapor to condense onto inner walls of the tank, characterized in that the machine further comprises at least one upper aperture (6) in said tank (1); at least one lower aperture (7) in said tank; and a conduit (8) extending outside the tank, interconnecting the apertures without a dehumidifier therein, and capable of bringing about a circulation of said vapor along a closed-loop flow-path defined by said tank (1) and said conduit (8), so as to cause the temperature of said vapor to become substantially homogeneous inside the tank, thereby improving drying of the washload items.

2. A dishwashing machine according to claim 1, characterized in that at least one fan means (9) is provided in said closed-loop flow-path.

3. A dishwashing machine according to claim 1, characterized in that the machine does not have a condenser for cooling vapor and condensing moisture in the conduit.

4. A dishwashing machine according to claim 1, characterized in that the machine does not have a forced-flow condenser for cooling vapor and condensing moisture in the conduit.

5. A dishwashing machine according to claim 1, characterized in that the machine does not have a condenser for cooling vapor and condensing moisture in the conduit wherein a cooling medium is forced through the condenser.

* * * * *

UNITED STATES PATENT AND TRADEMARK OFFICE

CERTIFICATE OF CORRECTION

PATENT NO. : 5,875,802

DATED : March 2, 1999

INVENTOR(S) : Favaro et al.

It is certified that error appears in the above-indentified patent and that said Letters Patent is hereby corrected as shown below:

On the Title Page, under References Cited, U.S. PATENT DOCUMENTS, delete "3,103,737 9/1963 Jellies" and insert --3,130,737 4/1964 Jellies--.

On the Title Page, under References Cited, FOREIGN PATENT DOCUMENTS, after last reference, add

| | | |
|---|---|---|
| --2,487,186 | 1/1982 | France |
| 2,521,850 | 8/1983 | France |
| 2,491,322 | 4/1982 | France |
| 4-122350 | 4/1992 | Japan |
| 5-115419 | 5/1993 | Japan |
| 5-154084 | 6/1993 | Japan--. |

On the Title Page, after the FOREIGN PATENT DOCUMENTS section, add the reference --EUROPEAN PATENT OFFICE 358,279 (EPO'279)--.

Signed and Sealed this

Twenty-fifth Day of April, 2000

*Attest:*

*Attesting Officer*

Q. TODD DICKINSON

*Director of Patents and Trademarks*